US011905090B2

(12) United States Patent
Nukui et al.

(10) Patent No.: US 11,905,090 B2
(45) Date of Patent: Feb. 20, 2024

(54) FLUID PACKAGE AND FLUID PACKAGE UNIT

(71) Applicant: BROTHER KOGYO KABUSHIKI KAISHA, Nagoya (JP)

(72) Inventors: Kosuke Nukui, Nagoya (JP); Kenta Hasebe, Nagoya (JP); Ai Sakaguchi, Kariya (JP); Eiichi Fujiwara, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 142 days.

(21) Appl. No.: 17/707,009

(22) Filed: Mar. 29, 2022

(65) Prior Publication Data

US 2022/0306365 A1 Sep. 29, 2022

(30) Foreign Application Priority Data

Mar. 29, 2021 (JP) ..... 2021-055503

(51) Int. Cl.
*B65D 75/30* (2006.01)
*B65D 81/30* (2006.01)
*B65D 75/58* (2006.01)

(52) U.S. Cl.
CPC ..... *B65D 75/30* (2013.01); *B65D 75/5866* (2013.01); *B65D 81/30* (2013.01)

(58) Field of Classification Search
CPC .... B65D 75/30; B65D 75/5866; B65D 81/30; B65D 75/26; B65D 75/5883; B65D 75/20
See application file for complete search history.

(56) References Cited

U.S. PATENT DOCUMENTS 7,527,367 B2 * 5/2009 Morita ..... B41J 2/17513 347/85

FOREIGN PATENT DOCUMENTS

| | | |
|---|---|---|
| JP | 2004-066753 A | 3/2004 |
| JP | 2005-138874 A | 6/2005 |
| JP | 2010-149454 A | 7/2010 |

* cited by examiner

*Primary Examiner* — Lisa Solomon
(74) *Attorney, Agent, or Firm* — KENEALY VAIDYA LLP

(57) ABSTRACT

A fluid package, having a pouch with a compartment apartment delimited by a film and a spout, is provided. The film includes an outer layer, an inner layer, a light-shielding layer, and a bonding layer. An outer periphery of the light-shielding layer is located at a position on an inner side of outer peripheries of the outer layer and the inner layer, at one of a position same as an outer periphery of the container compartment and a position on an outer side with respect to the outer periphery of the container compartment. The light-shielding layer covers an entirety of the container compartment and blocks ultraviolet rays. The bonding layer bonds the outer layer and the inner layer with the light-shielding layer interposed there-between. The bonding layer includes a directly-bonded area, in which the outer layer and the inner layer are directly bonded, in a range surrounding the light-shielding layer.

7 Claims, 8 Drawing Sheets

FLUID PACKAGE AND FLUID PACKAGE UNIT

CROSS REFERENCE TO RELATED APPLICATION

This application claims priority under 35 U.S.C. § 119 from Japanese Patent Application No. 2021-055503, filed on Mar. 29, 2021, the entire subject matter of which is incorporated herein by reference.

BACKGROUND

The present disclosure is related to a fluid package and a fluid package unit.

A packaging bag for containing fluid is known. A part of the packaging bag may form a concealing area, which includes a base layer, a pattern-printed layer arranged on an inner side of the base layer, and a middle layer bonded with a layer of adhesive agent to the base layer, with the pattern-printed layer interposed between the base layer and the middle layer.

SUMMARY

In the known packaging bag, the pattern-printed layer may be smaller than the base layer and the middle layer, and the base layer and the middle layer may be directly bonded to each other at rims on outer sides of the pattern-printed layer. Therefore, bonding between the base layer and the intermediate layer, which may be weakened at the part where the pattern-printed layer intervenes between the base layer and the intermediate layer, may be restrained from lowering at the rims.

However, for example, for containing contents such as ultraviolet (UV)-curable ink in a compartment in the packaging bag, in order to prevent the contents from hardening, the packaging bag may need to have a light-shielding property. While the known packaging bag may have the light-shielding function in the pattern-printed layer, with the pattern-printed layer being smaller than the compartment, the contents may not be shielded sufficiently from light.

The present disclosure is advantageous in that a fluid package and a fluid package unit, in which insufficient bonding between layers due to an arrangement of a printed layer and hardening by UV rays may be restrained, are provided.

According to an aspect of the present disclosure, a fluid package, including a pouch having a form of a bag configured to contain fluid in a container compartment delimited by a film, and a spout continuous with the container compartment, is provided. The film includes an outer layer, an inner layer, a light-shielding layer, and a bonding layer. The inner layer is arranged closer than the outer layer to the container compartment in a layered direction, in which the outer layer and the inner layer are layered. The light-shielding layer is arranged between the outer layer and the inner layer in the layered direction. The light-shielding layer has an outer periphery located at a position on an inner side with respect to an outer periphery of the outer layer and an outer periphery of the inner layer in an orthogonal direction intersecting orthogonally with the layered direction. The outer periphery of the light-shielding layer is located at one of a same position as an outer periphery of the container compartment and a position on an outer side with respect to the outer periphery of the container compartment in the orthogonal direction. The light-shielding layer covers an entirety of the container compartment. The light-shielding layer is configured to block ultraviolet rays. The bonding layer bonds the outer layer and the inner layer, with the light-shielding layer interposed between the outer layer and the inner layer. The bonding layer includes a directly-bonded area, in which the outer layer and the inner layer are directly bonded with the bonding layer, in a range surrounding the light-shielding layer.

According to another aspect of the present disclosure, a fluid package unit, including a fluid package, an attachment section, and a roll-up assembly, is provided. The fluid package includes a pouch having a form of a bag configured to contain fluid in a container compartment delimited by a film and a spout continuous with the container compartment. The film includes an outer layer, an inner layer, a light-shielding layer, and a bonding layer. The inner layer is arranged closer than the outer layer to the container compartment in a layered direction, in which the outer layer and the inner layer are layered. The light-shielding layer is arranged between the outer layer and the inner layer in the layered direction. The light-shielding layer has an outer periphery located at a position on an inner side with respect to an outer periphery of the outer layer and an outer periphery of the inner layer in an orthogonal direction intersecting orthogonally with the layered direction. The outer periphery of the light-shielding layer is located at one of a same position as an outer periphery of the container compartment and a position on an outer side with respect to the outer periphery of the container compartment in the orthogonal direction. The light-shielding layer covers an entirety of the container compartment. The light-shielding layer is configured to block ultraviolet rays. The bonding layer bonds the outer layer and the inner layer, with the light-shielding layer interposed between the outer layer and the inner layer. The bonding layer includes a directly-bonded area, in which the outer layer and the inner layer are directly bonded with the bonding layer, in a range surrounding the light-shielding layer. To the attachment section, the fluid package is detachably attachable. The roll-up assembly is configured to roll up the pouch of the fluid package attached to the attachment section. The pouch includes, in a range surrounding the container compartment, a spout-welding section, in which the spout and the film are welded, and a film-welding section, in which a part of the film and another part of the film facing each other with the container compartment interposed there-between in the layered direction are partly welded. The film-welding section includes a bottom welding section having a triangular form. The bottom welding section is arranged farther than the container compartment from the spout in a first direction parallel to the orthogonal direction. The pouch is configured to be rolled up by the roll-up assembly in a direction from the bottom welding section toward the spout.

DETAILED DESCRIPTION

In the following paragraphs, with reference to the accompanying drawings, an embodiment of the present disclosure will be described. It is noted that a fluid package described below is merely one embodiment of the present disclosure, and various connections may be set forth between elements in the following description. These connections in general and, unless specified otherwise, may be direct or indirect and that this specification is not intended to be limiting in this respect. In the following paragraphs and the accompanying drawings, identical or equivalent elements are referred to and denoted by same reference signs.

Embodiment

Configuration of Fluid Package

Figure 1:
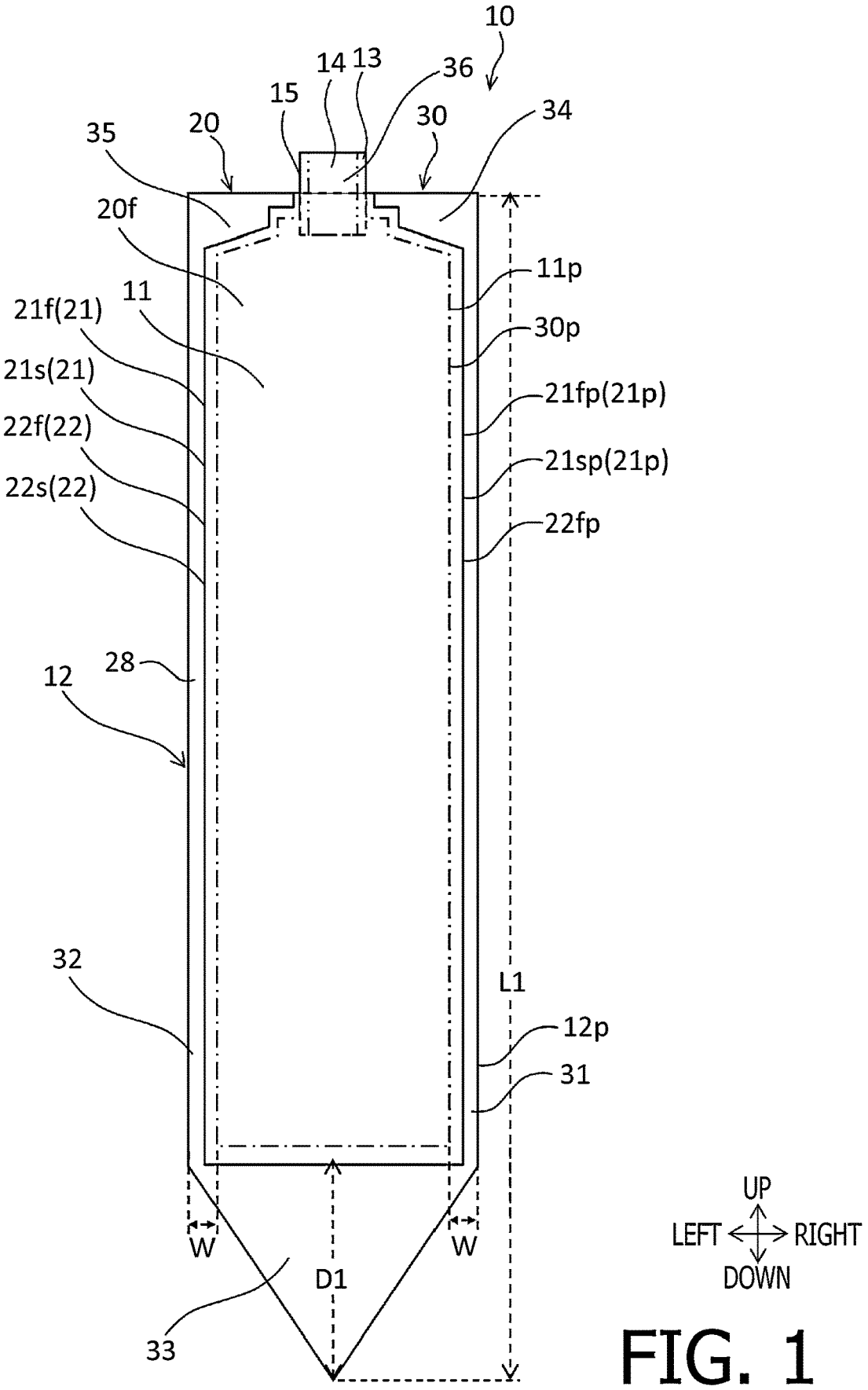
FIG. 1 is an illustrative frontside view of a fluid package according to an embodiment of the present disclosure.
Figure 2:
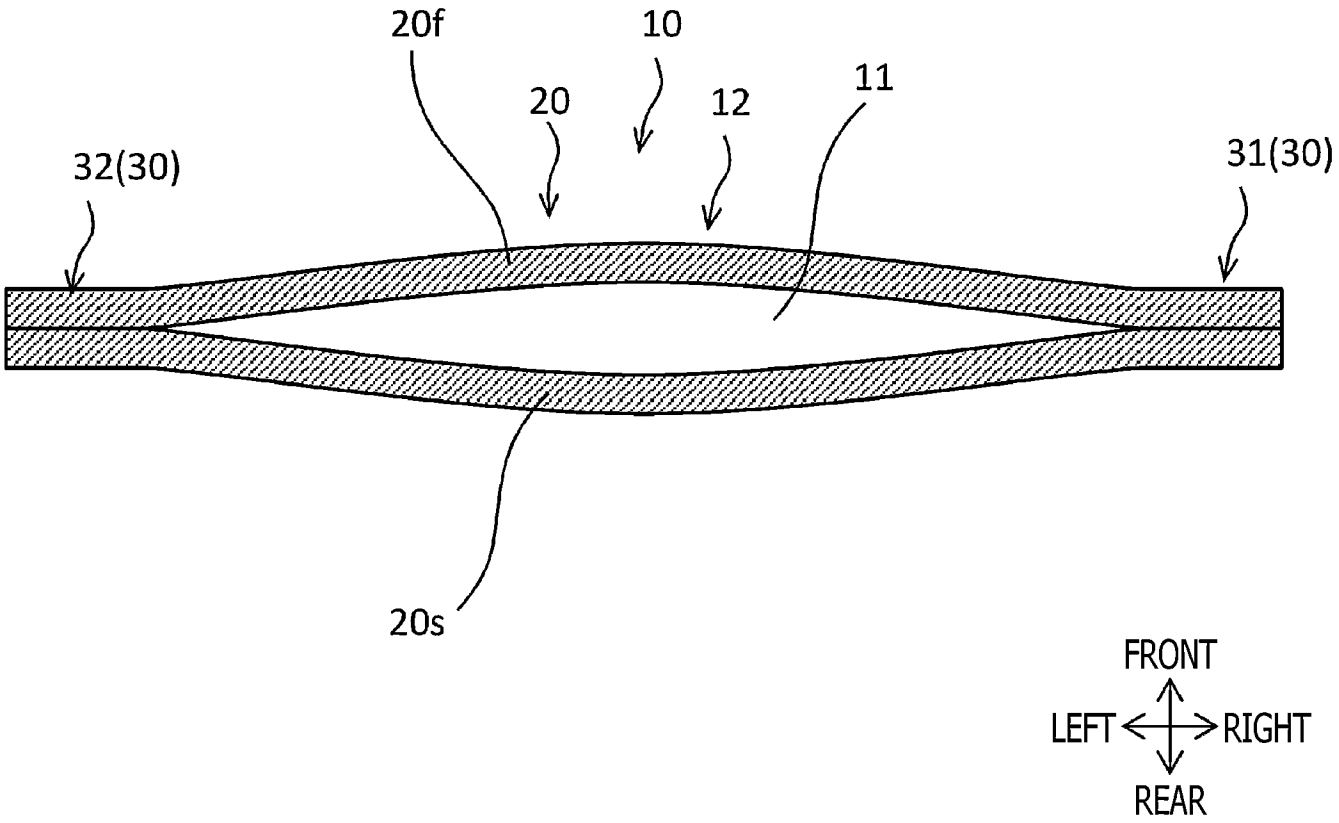
FIG. 2 is a cross-sectional view sectioned along a plane spreading orthogonally to a vertical direction according to the embodiment of the present disclosure.

A fluid package 10 shown in FIG. 1 is a container capable of containing fluid such as, for example, ink, drinking water, liquid detergent, and edible oil. As shown in FIGS. 1 and 2, the fluid package 10 includes a pouch 12, which has a form of a bag to contain fluid in a container compartment 11 delimited by a film 20, and a spout 13 continuous with the container compartment 11. The film 20 includes an outer layer 25 and an inner layer 23. The inner layer 23 is arranged closer than the outer layer 25 to the container compartment 11 in a layered direction, in which the outer layer 25 and the inner layer 23 are layered.

In this description, the layered direction, in which the outer layer 25 and the inner layer 23 are layered, may be called as a front-rear direction. A first direction intersecting with the front-rear direction, for example, orthogonally, may be called as a vertical direction. A second direction intersecting with the front-rear direction and with the vertical direction, for example, orthogonally, may be called as a widthwise direction. However, an orientation of the fluid package 10 may not necessarily be based on these directions.

The pouch 12 may be in, for example, an approximately pentagonal shape having a length L1 in the vertical direction. The pouch 12 has a first wall 20*f* and a second wall 20*s*, between which the container compartment 11 is formed in the front-rear direction. The pouch 12 has, in a range surrounding the container compartment 11 in a direction intersecting orthogonally with the vertical direction, an insertion port 15, in which the spout 13 may be inserted, a film-welding section 30, in which the first wall 20*f* and the second wall 20*s* are welded, and a spout-welding section 36, in which the first wall 20*f* and the second wall 20*s* are welded with the spout 13.

The insertion port 15 is located at a widthwise center of the pouch 12 and is surrounded by the film-welding section 30 in the widthwise direction. The insertion port 15 is connected to an upper opening of the container compartment 11 at a lower end thereof, extending upward from the container compartment 11, and is open at an upper end thereof.

The spout 13 is in a tubular form, which may be, for example a round or multifaceted tube, having a connection path 14 inside thereof. The spout 13 may be formed in, for example, resin. The spout 13 is inserted in the insertion port 15 of the pouch 12 at a lower part thereof, with the connection path 14 extending in the vertical direction, and protrude upward from an upper end of the pouch 12. The lower part of the spout 13 is fitted to the pouch 12 through the spout-welding section 36 so that the spout 13 is sealed to the pouch 12. The inside and the outside of the container compartment 11 of the pouch 12 are connected through the connection path 14, which provides a passage for the fluid in the container compartment 11 to flow outside.

The film 20 has flexibility and includes the first wall 20*f* and the second wall 20*s*. The second wall 20*s* is arranged rearward with respect to the first wall 20*f*. The first wall 20*f* and the second wall 20*s* have an identical shape and a same area dimension and are arranged to overlap each other.

Figure 3A:
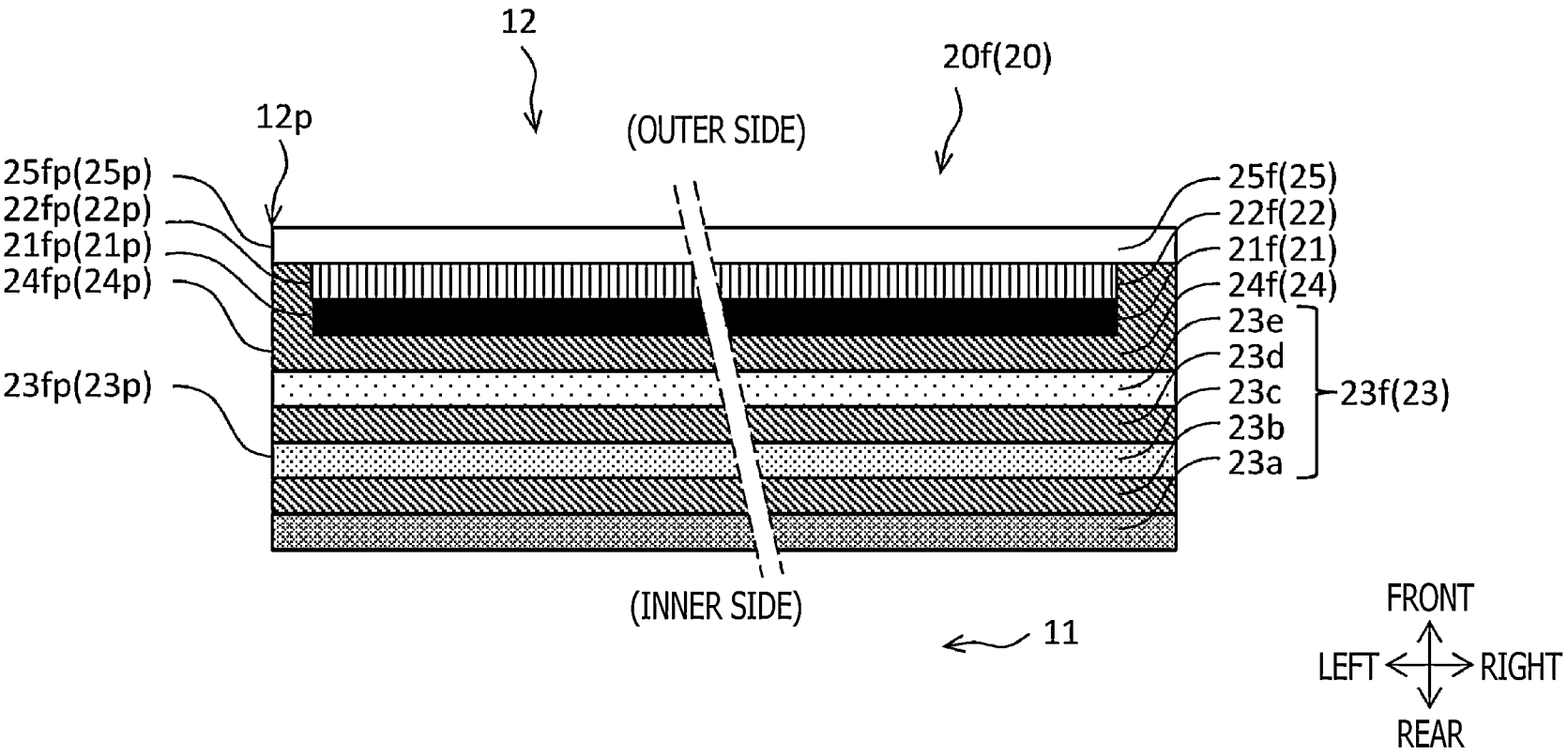
FIG. 3A is a cross-sectional view of a first wall of the fluid package according to the embodiment of the present disclosure.

The first wall 20*f* includes, as shown in FIG. 3A, a first inner layer 23*f* being a part of the inner layer 23, a first bonding layer 24*f* being a part of a bonding layer 24, a first light-shielding layer 21*f* being a part of the light-shielding layer 21, a first display-printing layer 22*f* being a part of a display-printing layer 22, and a first outer layer 25*f* being a part of the outer layer 25. The first light-shielding layer 21*f* is layered over the first inner layer 23*f*, with the first bonding layer 24*f* intervening between the first light-shielding layer 21*f* and the first inner layer 23*f* The first display-printing layer 22*f* is layered over the first light-shielding layer 21*f*. The first outer layer 25*f* is layered over the first display-printing layer 22*f*.

The first inner layer 23*f* is arranged rearward with respect to the first outer layer 25*f* in the front-rear direction and on an inner side, i.e., closer to the container compartment 11, with respect to the first outer layer 25*f* within the pouch 12. The first inner layer 23*f* forms an inner surface of the pouch 12 and an inner surface of the first wall 20*f* The first outer layer 25*f* forms an outer surface of the pouch 12 and an outer surface of the first wall 20*f*.

The first inner layer 23*f* is transparent and may have, for example, a rectangular shape, and includes a plurality of layers. In the example shown in FIG. 3A, the first inner layer 23*f* includes a first layer 23*a*, a second layer 23*c* layered over the first layer 23*a* through a bonding layer 23*b*, and a third layer 23*e* layered over the second layer 23*c* through a bonding layer 23*d*. Within the first inner layer 23*f*, the first layer 23*a* may be arranged on an inner side with respect to the third layer 23*e* and form the inner surface of the pouch 12 and the inner surface of the first wall 20*f*. However, a layering order of the layers within the first inner layer 23*f* is not necessarily limited to the order as described above.

The first layer 23*a* may be made of, for example, polyethylene resin, which allows the first wall 20*f* and the second wall 20*s* to be welded. The second layer 23*c* may be made of, for example, nylon resin to provide flexibility in the film 20. The third layer 23*e* may be made of, for example, PET resin, which may prevent gas from passing through. Optionally, however the first inner layer 23*f* may consist of a single layer.

The bonding layer 23*b*, the bonding layer 23*d*, and the first bonding layer 24*f* may be made of, for example, resin, such as acrylic resin and epoxy resin, having adhesiveness.

The first bonding layer 24*f* may be, for example, transparent and has an area dimension larger than an area dimension of the first light-shielding layer 21*f* and larger than an area dimension of the first display-printing layer 22*f*. The first bonding layer 24*f* has a shape and an area dimension identical to the first inner layer 23*f* and the first outer layer 25*f* In a direction intersecting orthogonally with the front-rear direction, outer peripheries 24*fp* of the first bonding layer 24*f* surround outer peripheries 21*pf* of the first light-shielding layer 21*f* and outer peripheries 22*fp* of the first display-printing layer 22*f* and coincide with outer peripheries 23*fp* of the first inner layer 23*f* and outer peripheries 25*fp* of the first outer layer 25*f* to form outer peripheries 12*p* of the pouch 12. In the following paragraphs, the description is based on a condition where the outer peripheries 21*fp* of the first light-shielding layer 21*f* and the outer peripheries 22*fp* of the first display-printing layer 22*f* coincide with each other. Optionally, however, the outer peripheries 22*fp* of the first display-printing layer 22*f* may surround the outer peripheries 21*fp* of the first light-shielding layer 21*f*.

In this arrangement, in a range including the outer peripheries 21*fp* of the first light-shielding layer 21*f* and an area on an inner side with respect to the outer peripheries 21*fp* in the direction intersecting orthogonally with the front-rear direction, the first bonding layer 24*f* bonds the first inner layer 23*f* and the first light-shielding layer 21*f* to each other. Meanwhile, in areas on outer sides with respect to the outer peripheries 21*fp* of the first light-shielding layer 21*f*, the first bonding layer 24*f* bonds the first inner layer 23*f* and the first outer layer 25*f* to each other and forms a directly-bonded area 28.

Thus, the directly-bonded area 28 is an area in the film 20, in which the inner layer 23 and the outer layer 25 are directly bonded with the bonding layer 24. The inner layer 23, the outer layer 25, and the bonding layer 24 are transparent. The directly-bonded area 28 does not include the light-shielding layer 21 or the display-printing layer 22. Therefore, the directly-bonded area 28 is transparent. In this context, the term "transparent" may mean permeability of light and may include translucency and colored transparency.

The first light-shielding layer 21*f* blocks the UV rays and has a higher UV-blocking rate than the other layers. The UV-blocking rate may be determined in advance according to a required level depending on the fluid. For example, the first light-shielding layer 21*f* is a printable layer, which may be formed in an ink in a color having a higher UV-blocking rate, such as black, applied onto the first bonding layer 24*f*. The first light-shielding layer 21*f* may be, for example, a metal foil such as aluminum, and a metal layer of a metal vapor deposition film, in which a metal such as aluminum is deposited on a thin film of, for example, resin.

The outer peripheries 21*fp* of the first light-shielding layer 21*f* are located on an inner side with respect to the outer peripheries 12*p* of the pouch 12 and at positions the same as the outer peripheries 11*p* of the container compartment 11 or on outer sides with respect to the outer peripheries 11*p* of the container compartment 11 in the direction intersecting orthogonally with the front-rear direction. Therefore, the first light-shielding layer 21*f* has an area dimension equal to or larger than an area dimension of the container compartment 11 on a front side and covers an entirety of the front side of the container compartment 11.

The first display-printing layer 22*f* is, as shown in FIG. 3A, a layer for displaying information, such as, for example, information indicating contents of the fluid contained in the container compartment 11. The first display-printing layer 22*f* is located farther in the front-rear direction from the container compartment 11 than the first light-shielding layer 21*f*. The first display-printing layer 22*f* is layered over the first light-shielding layer 21*f* and covers at least a part of the first light-shielding layer 21*f*. For example, the first display-printing layer 22*f* may be a printing layer formed by applying an ink in a color, which is different from the color of the first light-shielding layer 21*f*, onto the first light-shielding layer 21*f*.

The first outer layer 25*f* covers the first display-printing layer 22*f* in a range including the outer peripheries 22*fp* of the first display-printing layer 22*f* and on an are on an inner side with respect to the outer peripheries 22*fp* of the first display-printing layer 22*f* in the direction intersecting orthogonally with the front-rear direction to protect the first display-printing layer 22*f* from the outside. The first outer layer 25*f* is made of transparent resin to allow the first display-printing layer 22*f* to be visually recognized from the outside of the pouch 12. The first outer layer 25*f* covers the first bonding layer 24*f* on an outer side with respect to the first display-printing layer 22*f* in the direction intersecting orthogonally to the front-rear direction to protect the first bonding layer 24*f* from the outside.

Figure 3B:
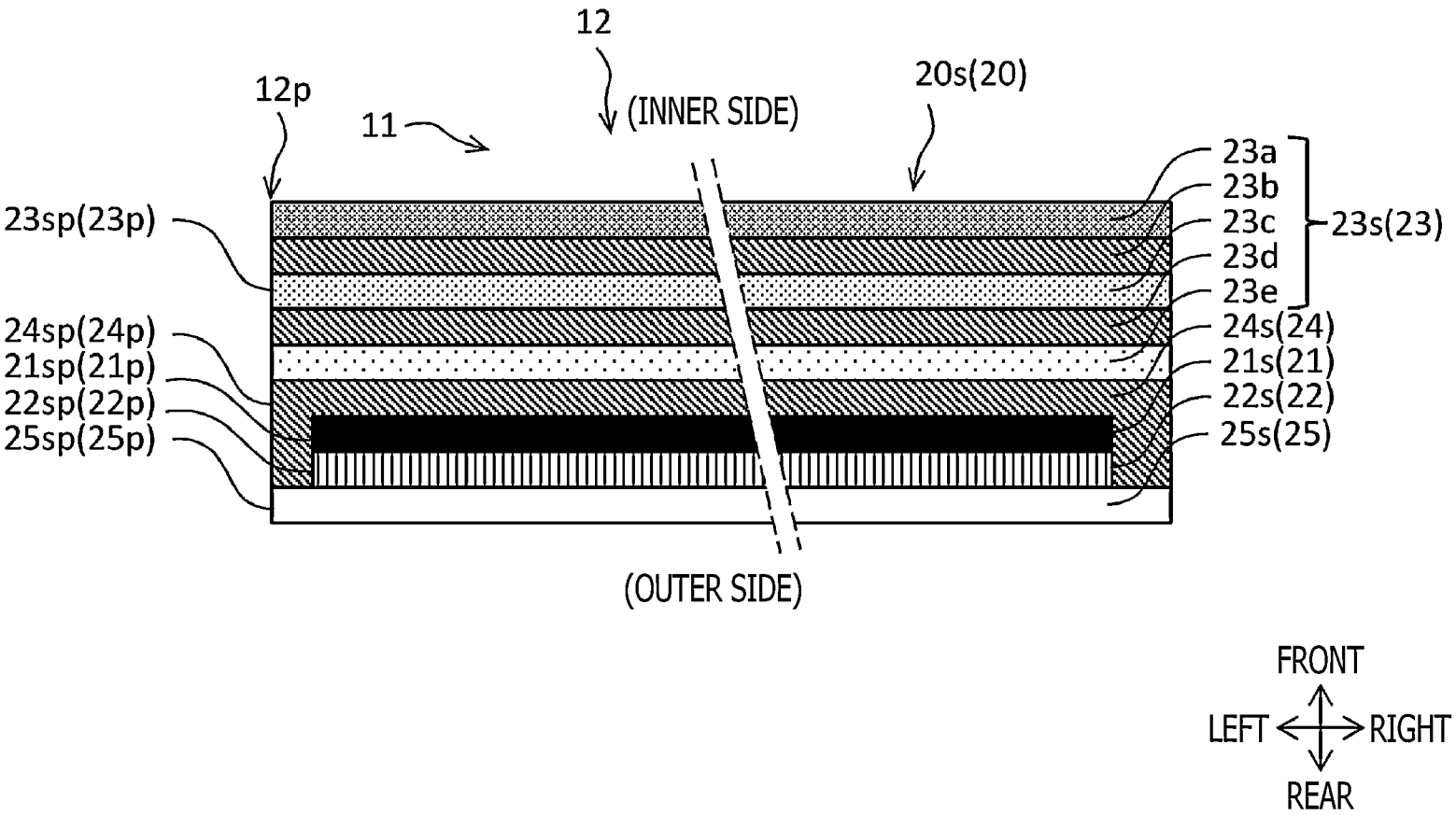
FIG. 3B is a cross-sectional view of a second wall of the fluid package according to the embodiment of the present disclosure.

The second wall 20*s* includes, as shown in FIG. 3B, a second inner layer 23*s* being another part of the inner layer 23, a second bonding layer 24*s* being another part of the bonding layer 24, a second light-shielding layer 21*s* being another part of the light-shielding layer 21, a second display-printing layer 22*s* being another part of the display-printing layer 22, and a second outer layer 25*s* being another part of the outer layer 25. The second light-shielding layer 21*s* is layered over the second inner layer 23*s* with the second bonding layer 24*s* intervening between the second light-shielding layer 21*s* and the second inner layer 23*s*. The second display-printing layer 22*s* is layered over the second light-shielding layer 21*s*. The second outer layer 25*s* is layered over the second display-printing layer 22*s*.

The second inner layer 23*s* is in the same configuration as the first inner layer 23*f*, the second bonding layer 24*s* is in the same configuration as the first bonding layer 24*f*, the second light-shielding layer 21*s* is in the same configuration as the first light-shielding layer 21*f*, the second display-printing layer 22*s* is in the same configuration as the first display-printing layer 22*f*, and the second outer layer 25*s* is in the same configuration as the first outer layer 25*f*. In the following paragraphs, the first inner layer 23*f* and the second inner layer 23*s* may be collectively called as the inner layer 23, the first bonding layer 24*f* and the second bonding layer 24*s* may be collectively called as the bonding layer 24, the first light-shielding layer 21*f* and the second light-shielding layer 21*s* may be collectively called as the light-shielding layer 21, the first display-printing layer 22*f* and the second display-printing layer 22*s* may be collectively called as the display-printing layer 22, and the first outer layer 25*f* and the second outer layer 25*s* may be collectively called as the outer layer 25.

As shown in FIG. 1, the first light-shielding layer 21*f* and the second light-shielding layer 21*s* are in a same form having a same area dimension. In the pouch 12, the outer peripheries 21*fp* of the first light-shielding layer 21*f* and the outer peripheries 21*sp* of the second light-shielding layer 21*s* overlap each other and surround the outer peripheries of the container compartment 11. In other words, the first light-shielding layer 21*f* and the second light-shielding layer 21*s* cover the container compartment 11 entirely.

Directly-Bonded Area, Spout-Welding Section, and Film-Welding Section

Figure 4:
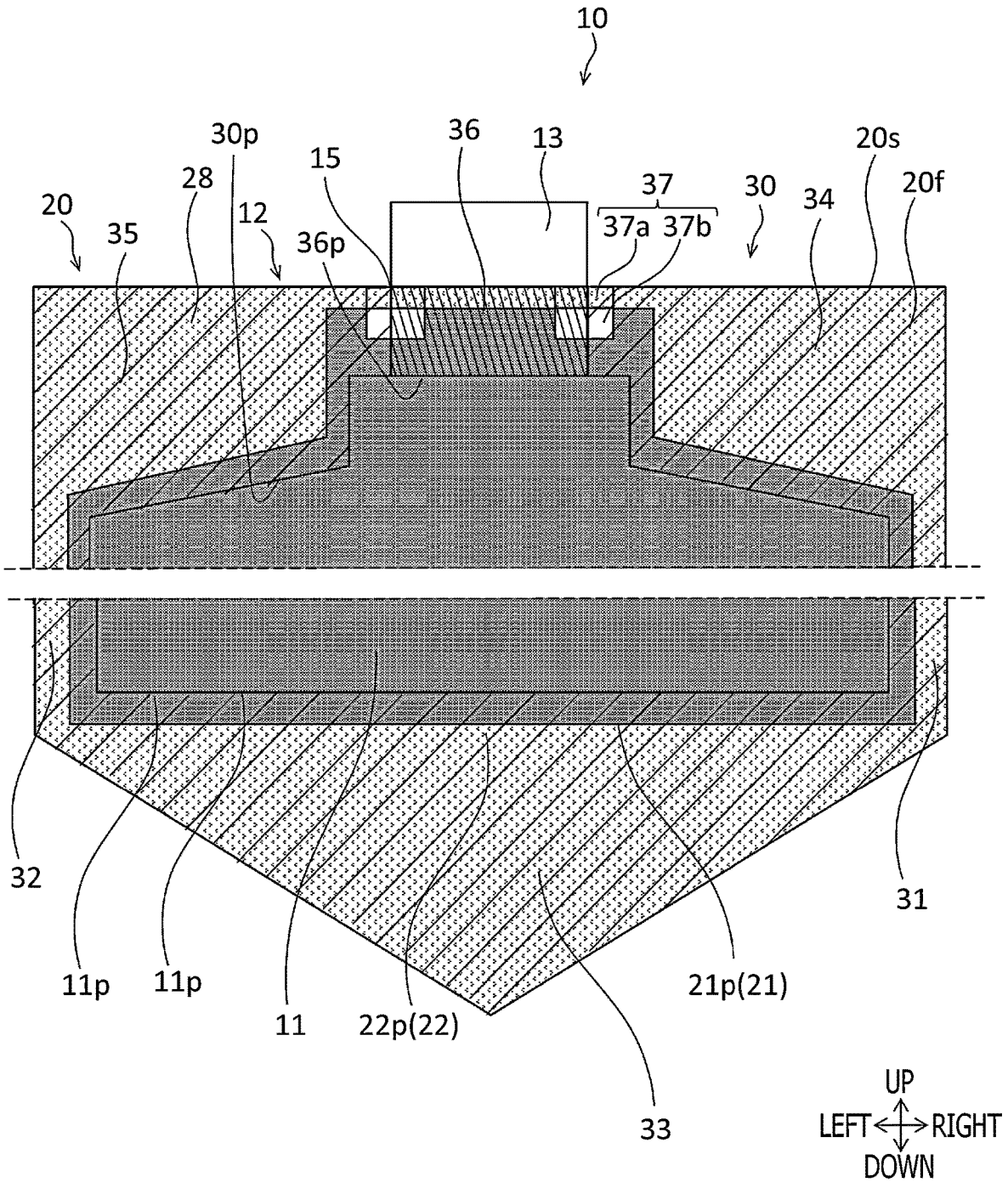
FIG. 4 is an enlarged frontside view of the fluid package according to the embodiment of the present disclosure.

As shown in FIG. 4, the spout-welding section 36 and the film-welding section 30 are arranged to surround the container compartment 11 to seal the container compartment 11. The spout-welding section 36 is a part formed of an outer peripheral surface of the lower part of the spout 13 inserted in the insertion port 15 and inner surfaces of the first wall 20*f* and the second wall 20*s* of the pouch 12 welded to each other.

The film-welding section 30 is formed of the first wall 20*f* and the second wall 20*s* welded to each other and may be approximately in a form of, for example, U. The film-welding section 30 includes a right-side welding section 31, a left-side welding section 32, a bottom welding section 33, a right-top welding section 34, and a left-top welding section 35. The right-side welding section 31 is arranged on a rightward side in the pouch 12 with respect to the container compartment 11, and the left-side welding section 32 is arranged on a leftward side in the pouch 12 with respect to the container compartment 11. The right-side welding section 31 and the left-side welding section 32 are arranged at positions opposite to each other across the container compartment 11 in the widthwise direction extending longitudinally in the vertical direction in parallel with each other.

The bottom welding section 33 is arranged at a lower position in the pouch 12 with respect to the container compartment 11. The bottom welding section 33 is connected to a lower end of the right-side welding section 31 and a lower end of the left-side welding section 32 at a rightward top end and a leftward top end thereof, respectively. The bottom welding section 33 may have, for example, a triangular form pointing downward, in which a dimension in the widthwise direction thereof is reduced toward a lower end. As shown in FIG. 1, a length D1 of the bottom welding section 33 in the vertical direction is larger than a length W of the right-side welding section 31 in the widthwise direction and larger than a length W of the left-side welding section 32 in the widthwise direction.

The right-top welding section 34 is arranged rightward with respect to the insertion port 15 on an upper side with respect to the container compartment 11, and the left-top welding section 35 is arranged leftward with respect to the insertion port 15 on the upper side with respect to the container compartment 11. The right-top welding section 34 extends rightward from a rightward end of the insertion port 15 and is connected to an upper end of the right-side welding section 31. The left-top welding section 35 extends leftward from a leftward end of the insertion port 15 and is connected to an upper end of the left-side welding section 32.

The directly-bonded area 28 is arranged on an outer side with respect to the outer periphery 21*p* of the light-shielding layer 21 and on an inner side with respect to the outer periphery 12*p* of the pouch 12 in the direction intersecting orthogonally with the front-rear direction. The outer periphery 21*p* of the light-shielding layer 21 is arranged between the outer periphery 11*p* of the container compartment 11, which includes a lower edge 36*p* of the spout-welding section 36 and an inner periphery 30*p* of the film-welding section 30, and the outer periphery 12*p* of the pouch 12. Therefore, the directly-bonded area 28 is located on an outer side with respect to the outer periphery 21*p* of the light-shielding layer 21 in the spout-welding section 36 and the film-welding section 30.

The bottom welding section 33 of the film-welding section 30 is located at a lower position with respect to the light-shielding layer 21 and is formed of the directly-bonded area 28. Optionally, a lower end of the light-shielding layer 21 may be located at a position between an upper end and a lower end of the bottom welding section 33. In other words, the bottom welding section 33 may partly include the light-shielding layer 21.

In the spout-welding section 36, and in the right-top welding section 34 and the left-top welding section 35 of the film-welding section 30, window sections 37 are arranged. Each window section 37 may be in, for example, a rectangular form and is arranged over a boundary between the spout-welding section 36 and the film-welding section 30 in the widthwise direction. Optionally, the window section 37 may be arranged in either one of the spout-welding section 36 and the film-welding section 30.

The window sections 37 are located on an upper side with respect to the container compartment 11 and extend downward from the upper end of the pouch 12. An upper part 37*a* of each window section 37 is formed of a part of the directly-bonded area 28, which is transparent. Therefore, in the vertical direction, an upper end of the directly-bonded area 28 and upper ends of the window sections 37 coincide with the upper end of the pouch 12, and a lower end of the directly-bonded area 28 is located between the upper ends and lower ends of the window sections 37. A lower part 37*b* of each window section 37 consists of the inner layer 23 and the outer layer 25 and does not include the light-shielding layer 21, the display-printing layer 22, or the bonding layer 24. Therefore, the lower parts 37*b* of the window sections 37 have a higher degree of transparency than upper parts 37*a* of the window sections 37.

In the fluid package 10 described above, the film 20 includes the transparent outer layer 25, the transparent inner layer 23, the light-shielding layer 21, and the bonding layer. The transparent inner layer 23 is arranged closer than the outer layer 25 to the container compartment 11 in the layered direction, e.g., the front-rear direction, in which the inner layer 23 and the outer layer 25 are layered. The light-shielding layer 21 is arranged between the outer layer 25 and the inner layer 23 in the front-rear direction and has the outer periphery, which is located at the position on the inner side with respect to the outer periphery of the outer layer 25 and the outer periphery of the inner layer 23 in the direction intersecting orthogonally with the front-rear direction and which is located at the position same as the outer periphery of the container compartment 11 or on the outer side with respect to the outer periphery of the container compartment 11 in the direction intersecting orthogonally with the front-rear direction. The light-shielding layer 21 covers the entirety of the container compartment 11. The light-shielding layer 21 blocks the ultraviolet rays. The bonding layer 24 bonds the outer layer 25 and the inner layer 23, with the light-shielding layer 21 interposed between the outer layer 25 and the inner layer 23. The bonding layer 24 includes the directly-bonded area 28, in which the outer layer 25 and the inner layer 23 are directly bonded with the bonding layer 24, in the range surrounding the light-shielding layer 21.

In this arrangement, the directly-bonded area 28, in which the inner layer 23 and the outer layer 25 are directly bonded with the bonding layer 24, is arranged around the light-shielding layer 21. Therefore, poor bonding between the layers in the film 20, which may be caused if the light-shielding layer 21 intervenes between the inner layer 23 and the outer layer 25, may be restrained. Moreover, in this arrangement, in which the light-shielding layer 21 covers the container compartment 11 entirely, the fluid in the container compartment 11 may be shielded from the light, and deterioration of the fluid that may be caused by the UV rays may be restrained.

Moreover, through the transparent directly-bonded area 28, leakage of the fluid from the container compartment 11 may be visually recognized easily. Further, the area dimension of the light-shielding layer 21 may be reduced so that rigidity of the pouch 12 that may otherwise be increased by the presence of the light-shielding layer 21 may be lowered. Therefore, the pouch 12 may be easily rolled. Moreover, if the light-shielding layer 21 is formed of a printing layer, the rigidity of the pouch 12 may be restrained from increasing even more effectively compared to a light-shielding layer 21 made of metal; therefore, the pouch 12 may be rolled more easily.

In the fluid package 10 described above, the film 20 includes the first wall 20*f* and the second wall 20*s*, between which the container compartment 11 is interposed in the front-rear direction. The light-shielding layer 21 includes the first light-shielding layer 21*f*, arranged in the first wall 20*f* and having the area dimension greater than the area dimension of the container compartment 11 in the direction intersecting orthogonally with the front-rear direction; and the second light-shielding layer 21*s*, arranged in the second wall and having the area dimension greater than the area dimension of the container compartment 11 in the direction intersecting orthogonally with the front-rear direction.

In this arrangement, each of the area dimension of the first light-shielding layer 21*f* and the area dimension of the second light-shielding layer 21*s* is greater than the area dimension of the container compartment 11. Therefore, when the first wall 20*f* and the second wall 20*s* are layered, even if the first light-shielding layer 21*f* and the second light-shielding layer 21*s* are displaced from each other, a situation, in which neither the first light-shielding layer 21*f* nor the second light-shielding layer 21*s* covers the container compartment 11, may be restrained.

The fluid package 10 described above has the spout 13 continuous with the container compartment 11. The pouch 12 includes, in the range surrounding the container compartment 11, the spout-welding section 36, in which the spout 13 and the film 20 are welded, and the film-welding section 30, in which a part of the film 20 and another part of the film 20 facing each other with the container compartment 11 interposed there-between in the front-rear direction are partly welded. The film 20 includes the transparent window section 37, in which a part of the directly-bonded area 28 is arranged, at least in one of the spout-welding section 36 and the film-welding section 30.

In this arrangement, leakage of the fluid from the container compartment 11 in the spout-welding section 36 or the film-welding section 30 may be visually recognizable easily through the transparent window sections 37. Moreover, the part of the window section 37, in which the directly-bonded area 28 is not provided, has the higher degree of transparency than the directly-bonded area 28. Therefore, the leakage of the fluid may be recognized even more easily through the part of the window section 37 not having the directly-bonded area 28.

Fluid Package Unit

A fluid package unit 40 may be, for example, provided in an apparatus having a printer that uses the fluid package 10. The fluid package 10 may be detachably attached or fixed to the apparatus. The fluid package unit 40 includes the fluid package 10 and a case 41.

The case 41 may have, for example, a form of cuboid which is open on a front side thereof. The case 41 has an opening 41*a*, a rear face 41*b*, and four (4) side faces 41*c*. The opening 41*a* is located on the front side of the case 41 and is surrounded by the four side faces 41*c*. The rear face 41*b* is located on a rear side of the case 41, which is opposite to the opening 41*a* in the front-rear direction. Inside the case 41, an attachment section 42 and a roll-up assembly 43 are arranged.

To the attachment section 42, the spout 13 of the fluid package 10 may be detachably attached. The roll-up assembly 43 may be located, for example, at a lower position with respect to the attachment section 42 and includes a blade spring 43*a*, a roller 43*b*, and a movable assembly 43*c*. The blade spring 43*a* may urge the pouch 12 against the roller 43*b*. The roller 43*b* extends axially in the widthwise direction and is movably supported by the movable assembly 43*c* to move in the vertical direction. The movable assembly 43*c* extends in the vertical direction along the side faces 41*c* and supports the roller 43*b* rotatably.

For using the fluid package unit 40, first, a user may insert the fluid package 10 through the opening 41*a* into the case 41. In particular, the user may have the front side of the fluid package 10 on the user's nearer side and the rear face of the fluid package 10 to face the rear face 41*b* of the case 41 on the user's farther side. In this arrangement, the user may visually recognize the display-printing layer 22, which is on the front side of the fluid package 10 through, the opening 41*a*. Therefore, when, for example, the user has a plurality of different types of cases 41, the user may refer to the contents of the display-printing layer 22 to install the fluid package 10 to a correct one of the cases 41.

Next, the user may attach the spout 13 of the fluid package 10 to the attachment section 42. In particular, the fluid package 10 may be placed in the attachment section 42 with the spout 13 on the upper side and the pouch 12 extending downward from the spout 13. Next, the user may interpose the bottom welding section 33 between the roller 43*b* and the blade spring 43*a*. Thereby, the bottom welding section 33 may be urged by the blade spring 43*a* against the roller 43*b*. As the fluid in the container compartment 11 is ejected outside, a thickness of the pouch 12 may be reduced. Accordingly, the roller 43*b* may rotate due to an urging force of the blade spring 43*a*, and the pouch 12 may be rolled up around the roller 43*b* from the bottom welding section 33, and the roller 43*b* may move toward the spout 13 along the movable assembly 43*c*. Optionally, a motor to rotate the roller 43*b* may be provided.

Figure 5:
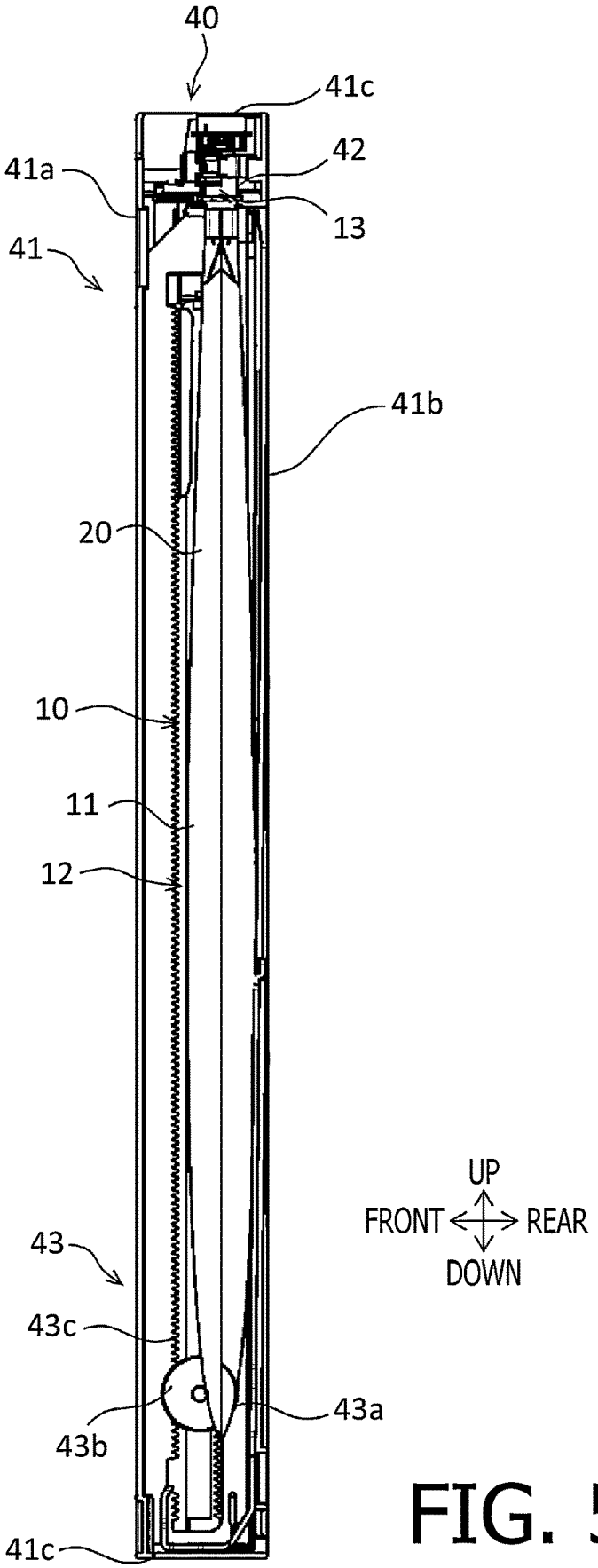
FIG. 5 is an illustrative view of the fluid package from right according to the embodiment of the present disclosure.

The fluid package unit 40 as described above has, as shown in FIGS. 4-5, the fluid package 10, the attachment section 42, to which the fluid package 10 is detachably attachable, and the roll-up assembly 43 to roll up the pouch 12 of the fluid package 10 attached to the attachment section 42. The fluid package 10 includes the spout 13 continuous with the container compartment 11. The pouch 12 includes, in the range surrounding the container compartment 11, the spout-welding section 36, in which the spout 13 and the film 20 are welded, and the film-welding section 30, in which a part of the film 20 and another part of the film 20 facing each other with the container compartment 11 interposed there-between in the front-rear direction are partly welded. The film-welding section 30 includes the bottom welding section 33, having the triangular form and arranged farther than the container compartment 11 from the spout 13 in the vertical direction. The pouch 12 may be rolled up by the roll-up assembly 43 in the direction from the bottom welding section 33 toward the spout 13.

According to this arrangement, the directly-bonded area 28 in the bottom welding section 33 does not include the light-shielding layer 21. Therefore, rigidity of the bottom welding section 33 may be reduced, and the bottom welding section 33 may be rolled up easily.

FIRST MODIFIED EXAMPLE

Figure 6A:
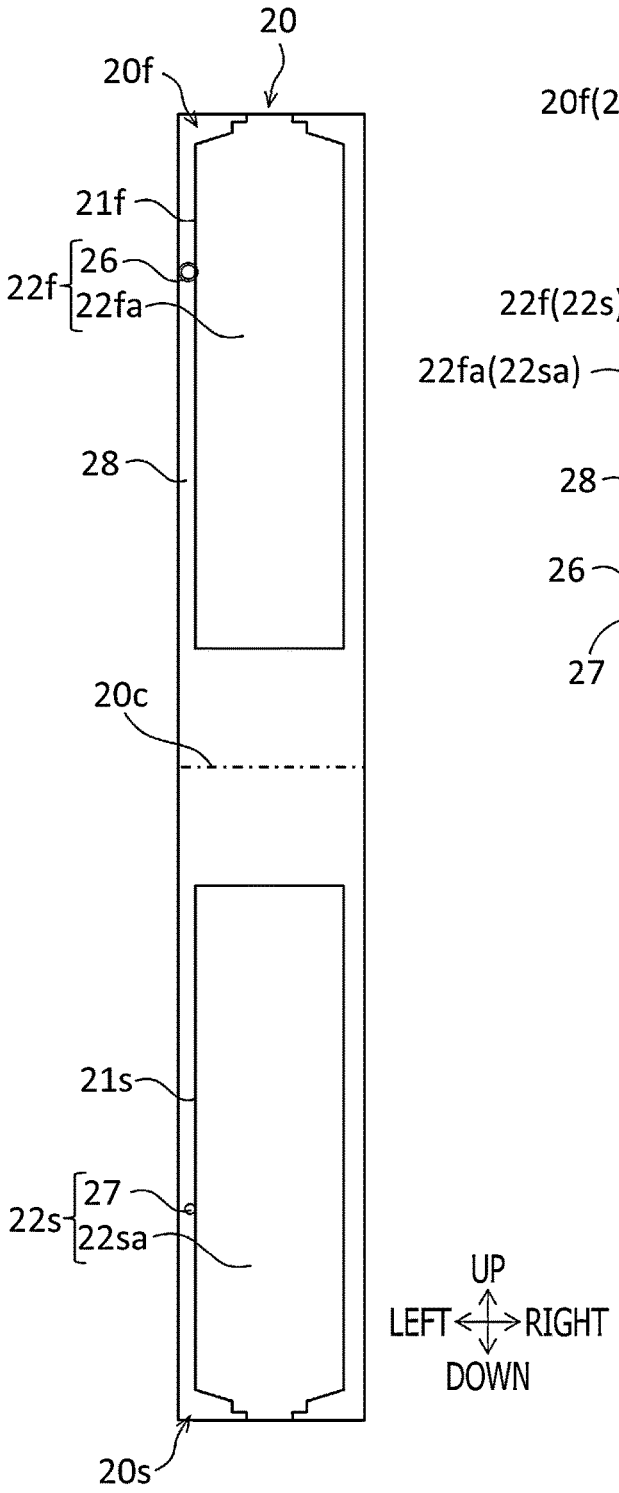
FIG. 6A is an illustrative frontside view of a film having a first index and a second index according to the embodiment of the present disclosure.

A first modified example of the fluid package 10 will be described below. In the fluid package 10 in the first modified example, similarly to the fluid package 10 in the previous embodiment as shown in FIGS. 3A-3B, and as shown in FIG. 6A, the film 20 has a first display-printing layer 22*f* for displaying information and a second display-printing layer 22*s* for displaying information. The first display-printing layer 22*f* is provided to the first wall 20*f* in an arrangement such that the first display-printing layer 22*f* may cover the first light-shielding layer 21*f* at a position farther than the first light-shielding layer 21*f* in the front-rear direction from the container compartment 11. The first display-printing layer 22*f* includes a first index 26. The second display-printing layer 22*s* is provided to the second wall 20*s* in an arrangement such that the second display-printing layer 22*s* covers the second light-shielding layer 21*s* at a position farther than the second light-shielding layer 21*s* in the front-rear direction from the container compartment 11. The second display-printing layer 22*s* includes a second index 27, which may locate the second display-printing layer 22*s* at a correct position with reference to the first index 26.

For example, as shown in FIG. 6A, the first display-printing layer 22*f* of the first wall 20*f* may have a first display part 22*fa* and the first index 26. The first display part 22*fa* may have an approximately pentagonal form and is layered over the first light-shielding layer 21*f*. The first index 26 may have an annular form and protrudes leftward from a leftward end of the first display part 22*fa* and is located leftward with respect to the first light-shielding layer 21*f*.

The second display-printing layer 22*s* of the second wall 20*s* may have a second display part 22*sa* and the second index 27. The second display part 22*sa* may have an approximately pentagonal form and is layered over the second light-shielding layer 21*s*. The second index 27 may have a circular form and protrudes leftward from a leftward end of the second display part 22*sa* and is located leftward with respect to the second light-shielding layer 21*s*. The second index 27 may be, when the first wall 20*f* and the second wall 20*s* are arranged to overlap each other, surrounded at a circumferential surface thereof by the first index 26.

Figure 6B:
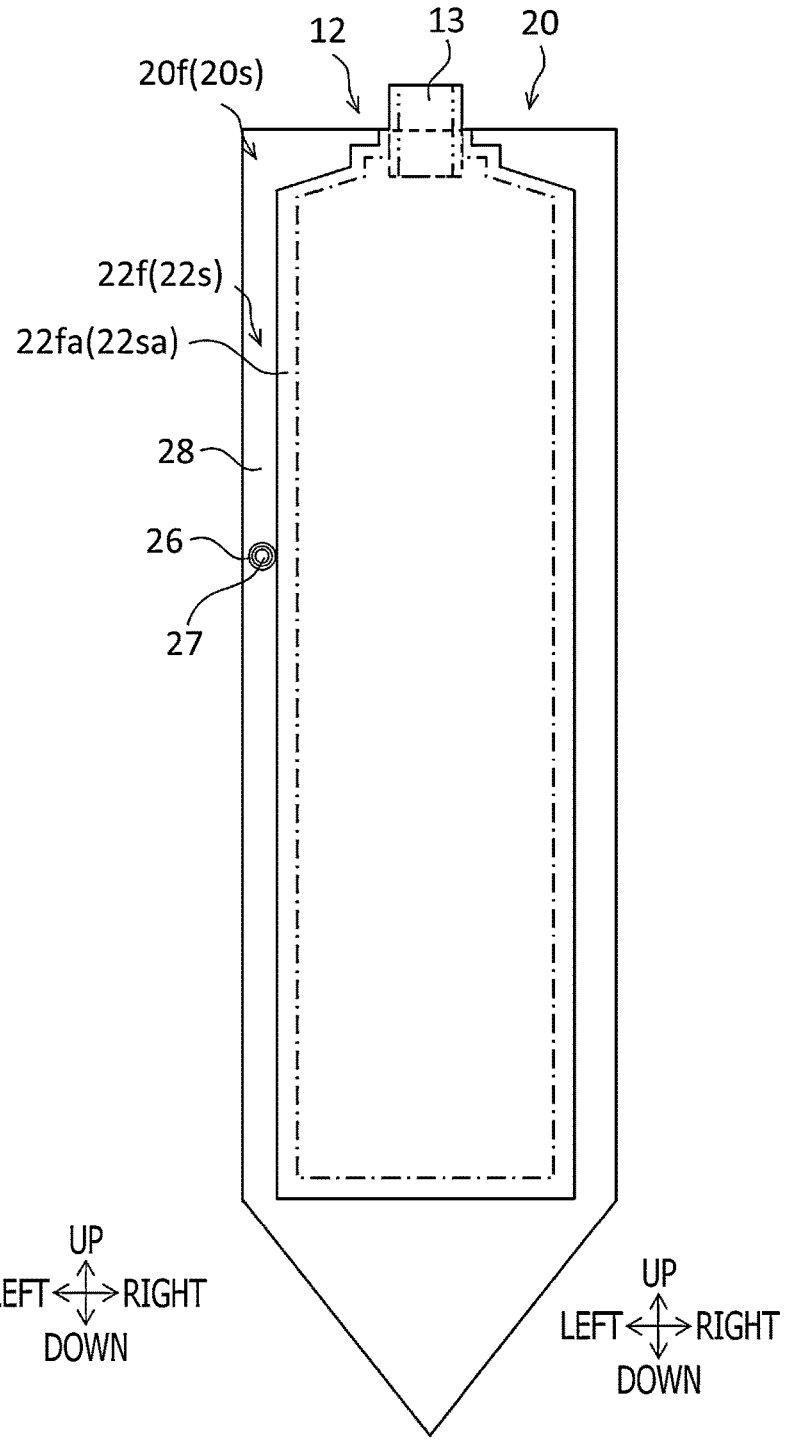
FIG. 6B is an illustrative frontside view of the fluid package using the film shown in FIG. 6A.

The first index 26 and the second index 27 are located on the directly-bonded area 28, which is transparent. Therefore, when the pouch 12 as shown in FIG. 6B is manufactured, the film 20 may be folded at a vertical center to form the folded edge 20*c*. Thereby, the first wall 20*f* on a front side with respect to the folded edge 20*c* and the second wall 20*s* on a rear side with respect to the folded edge 20*c* may overlap each other with the container compartment 11 interposed there-between. With the first wall 20*f* overlapping the second wall 20*s*, the second index 27 on the second wall 20*s* may be visually recognized through the directly-bonded area 28 in the first wall 20*f*. Therefore, the first wall 20*f* and the second wall 20*s* may be located at a correct position with respect to each other easily based on the first index 26 and the second index 27.

SECOND MODIFIED EXAMPLE

Figure 7A:
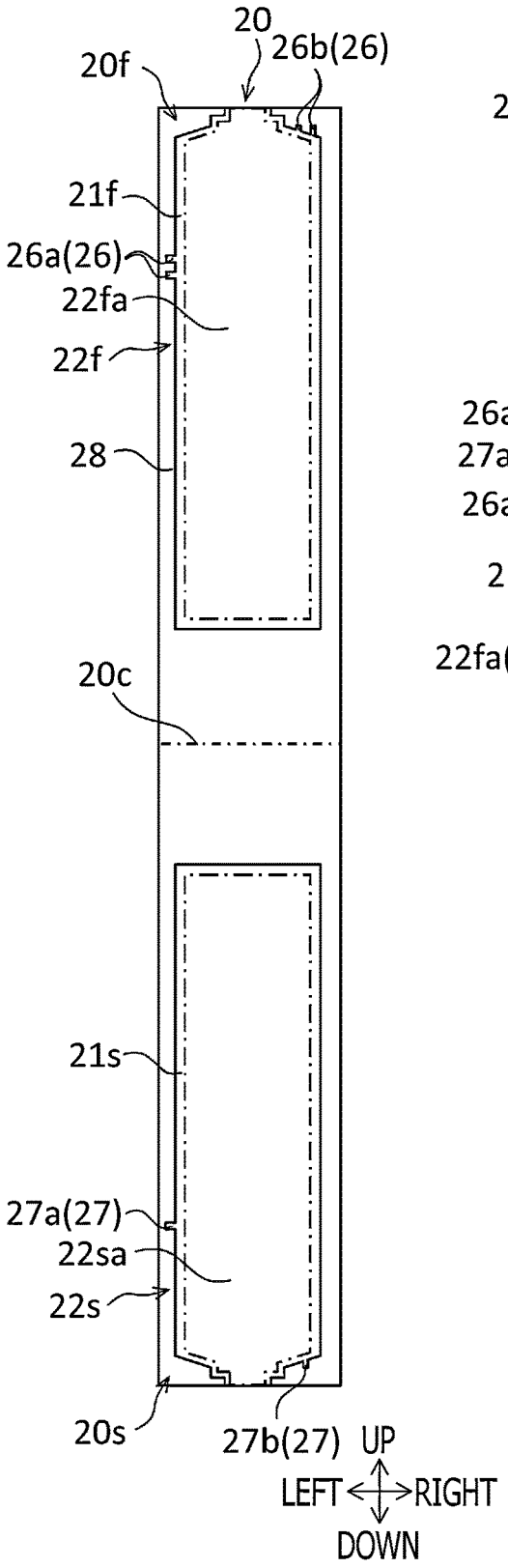
FIG. 7A is an illustrative frontside view of a film having a first lengthwise index, a first widthwise index, a second lengthwise index, and a second widthwise index according to the embodiment of the present disclosure.
Figure 7B:
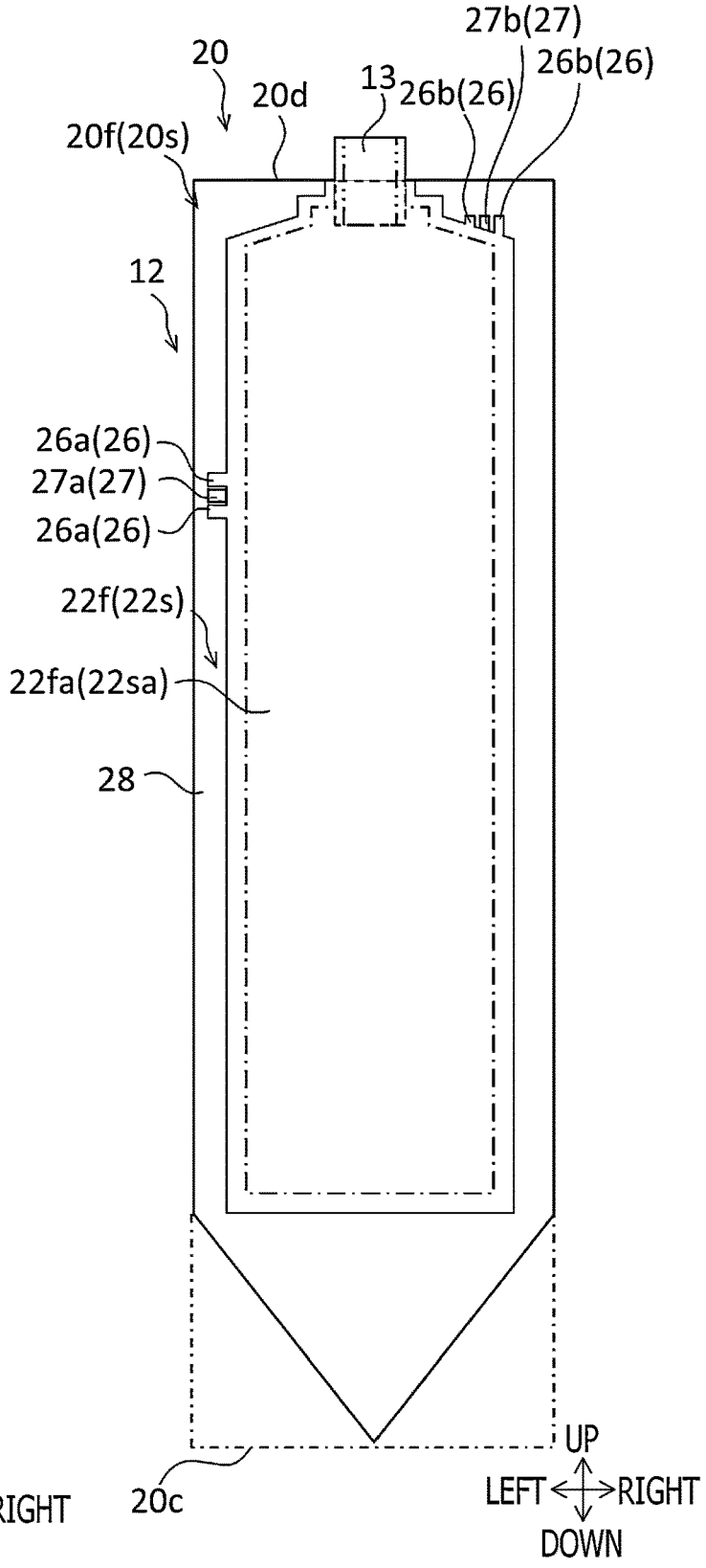
FIG. 7B is an illustrative frontside view of the fluid package using the film shown in FIG. 7A.

In the fluid package 10 in the second modified example, which may be modified further from the first modified example, the first index 26 includes a first lengthwise index 26*a* for positioning in the vertical direction and a first widthwise index 26*b* for positioning in the widthwise direction, as shown in FIGS. 7A-7B. The second index 27 includes a second lengthwise index 27*a*, which is arranged to align with the first lengthwise index 26*a* in the vertical direction, and a second widthwise index 27*b*, which is arranged to align with the first widthwise index 26*b* in the widthwise direction.

For example, as shown in FIG. 7A, the first display-printing layer 22*f* of the first wall 20*f* may have the first display part 22*fa*, a pair of first lengthwise indexes 26*a*, and a pair of first widthwise indexes 26*b*. Each of the first lengthwise indexes 26*a* may have a rectangular form and protrude leftward from a leftward end of the first display part 22*fa* and may be located leftward with respect to the first light-shielding layer 21*f*. The first lengthwise indexes 26*a* are spaced apart from each other in the vertical direction. Each first widthwise indexes 26*b* may have a rectangular form and protrudes upward from an upper end of the first display part 22*fa* and may be located at an upper position with respect to the first light-shielding layer 21*f*. The first widthwise indexes 26*b* are spaced apart from each other in the widthwise direction.

The second display-printing layer 22*s* of the second wall 20*s* may have the second display part 22*sa*, a second lengthwise index 27*a*, and a second widthwise index 27*b*. The second lengthwise index 27*a* may have a rectangular form and protrude leftward from a leftward end of the second display part 22*sa* and may be located leftward with respect to the second light-shielding layer 21*s*. The second widthwise index 27*b* may have a rectangular form and protrudes upward from an upper end of the second display part 22*sa* and may be located at an upper position with respect to the second light-shielding layer 21*s*. When the first wall 20*f* and the second wall 20*s* are arranged to overlap each other, the second lengthwise index 27*a* may be located between the first lengthwise indexes 26*a*, and the second widthwise index 27*b* may be located between the first widthwise indexes 26*b*.

When the pouch 12 is manufactured, the film 20 may be folded at a vertical center to form a folded edge 20*c*. Thereby, the first wall 20*f* on a front side with respect to the folded edge 20*c* and the second wall 20*s* on a rear side with respect to the folded edge 20*c* may overlap each other with the container compartment 11 interposed there-between. With the first wall 20*f* overlapping the second wall 20*s*, as shown in FIG. 7B, the first wall 20*f* and the second wall 20*s* may be located at a correct position with respect to each other easily based on the first lengthwise indexes 26*a* and the second lengthwise index 27*a*, which align in the vertical direction, and based on the first widthwise indexes 26*b* and the second widthwise index 27*b*, which align in the widthwise direction. Therefore, the first wall 20*f* and the second wall 20*s* may be located at a correct position with respect to each other in an improved accuracy.

THIRD MODIFIED EXAMPLE

In the fluid package 10 in the third modified example, which may be modified further from the first modified example, the pouch 12 has the folded edge 20*c*, at which the first light-shielding layer 21*f* and the second light-shielding layer 21*s* aligning in the vertical direction are folded to overlap each other with the container compartment 11 interposed there-between in the front-rear direction, and an opening edge 20*d*, which is distanced from the folded edge 20*c* by the container compartment 11 in the vertical direction. The second index 27 may be located closer than the folded edge 20*c* to the opening edge 20*d* in the vertical direction.

For example, when the pouch 12 is manufactured, as shown in FIG. 7A, the film 20 may be folded at a vertical center to form the folded edge 20*c*. Thereby, the first wall 20*f* on a front side with respect to the folded edge 20*c* and the second wall 20*s* on a rear side with respect to the folded edge 20*c* may overlap each other. With the first wall 20*f* overlapping the second wall 20*s*, an edge of the first wall 20*f* on a side opposite to the folded edge 20*c* in the vertical direction and an edge of the second wall 20*s* on a side opposite to the folded edge 20*c* in the vertical direction may overlap and form the opening edge 20*d*.

When, for example, the first wall 20*f* and the second wall 20*s* are displaced from each other, an amount of the displacement between the first wall 20*f* and the second wall 20*s* may be larger at a position farther from the folded edge 20*c* in the vertical direction than a position closer to the folded edge 20*c*. In this regard, the film 20 may be folded with reference to the first widthwise indexes 26*b* of the first wall 20*f* and the second widthwise index 27*b* of the second wall 20*s*, which are closer to the opening edge 20*d* than the folded edge 20*c* in the vertical direction, as shown in FIG. 7B, so that the first wall 20*f* and the second wall 20*s* may be located at a correct position with respect to each other in an improved accuracy.

Although examples of carrying out the invention have been described, those skilled in the art will appreciate that there are numerous variations and permutations of the fluid package and the fluid package unit that fall within the spirit and the scope of the invention as set forth in the appended claims. The embodiments described above may optionally be combined as long as they may coexist without conflicting. It is to be understood that the subject matter defined in the appended claims is not necessarily limited to the specific features or act described above. Rather, the specific features and acts described above are disclosed as example forms of implementing the claims. In the meantime, the terms used to represent the components in the above embodiment may not necessarily agree identically with the terms recited in the appended claims, but the terms used in the above embodiments may merely be regarded as examples of the claimed subject matters.

The present disclosure may be utilized to produce a fluid package and a fluid package unit that may reduce UV curing of fluid and poor bonding between layers due to presence of an intervening printable layer.

What is claimed is:

1. A fluid package, comprising:

a pouch having a form of a bag configured to contain fluid in a container compartment delimited by a film; and a spout continuous with the container compartment, wherein the film includes:

an outer layer;

an inner layer arranged closer than the outer layer to the container compartment in a layered direction, in which the outer layer and the inner layer are layered;

a light-shielding layer arranged between the outer layer and the inner layer in the layered direction, the light-shielding layer having an outer periphery located at a position on an inner side with respect to an outer periphery of the outer layer and an outer periphery of the inner layer in an orthogonal direction intersecting orthogonally with the layered direction, the outer periphery of the light-shielding layer being located at one of a same position as an outer periphery of the container compartment and a position on an outer side with respect to the outer periphery of the container compartment in the orthogonal direction, the light-shielding layer covering an entirety of the container compartment, the light-shielding layer being configured to block ultraviolet rays; and a bonding layer bonding the outer layer and the inner layer, with the light-shielding layer interposed between the outer layer and the inner layer, the bonding layer including a directly-bonded area, in which the outer layer and the inner layer are directly bonded with the bonding layer, in a range surrounding the light-shielding layer.

2. The fluid package according to claim 1, wherein the film includes a first wall and a second wall, between which the container compartment is interposed in the layered direction, and wherein the light-shielding layer includes:

a first light-shielding layer arranged in the first wall, the first light-shielding layer having an area dimension greater than an area dimension of the container compartment in the orthogonal direction; and a second light-shielding layer arranged in the second wall, the second light-shielding layer having an area dimension greater than the area dimension of the container compartment in the orthogonal direction.

3. The fluid package according to claim 2, wherein the film includes:

a first display-printing layer for displaying information, the first display-printing layer being arranged in the first wall at a position farther than the first light-shielding layer from the container compartment in the layered direction, the first display-printing layer covering the first light-shielding layer, the first display-printing layer including a first index; and a second display-printing layer for displaying information, the second display-printing layer being arranged in the second wall at a position farther than the second light-shielding layer from the container compartment in the layered direction, the second display-printing layer covering the second light-shielding layer, the second display-printing layer including a second index configured to be located at a correct position with respect to the first index.

4. The fluid package according to claim 3, wherein the first index includes:

a first lengthwise index for positioning in a first direction, the first direction being parallel to the orthogonal direction; and a first widthwise index for positioning in a second direction, the second direction being parallel to the orthogonal direction and to the first direction, and wherein the second index includes:

a second lengthwise index arranged to align with the first lengthwise index in the first direction; and a second widthwise index arranged to align with the first widthwise index in the second direction.

5. The fluid package according to claim 3, wherein the pouch includes:

a folded edge formed by folding the film at a position between the first light-shielding layer and the second light-shielding layer aligning in a first direction, the first direction being parallel to the orthogonal direction, and layering the first light-shielding layer and the second light-shielding layer with the container compartment interposed there-between in the layered direction; and an opening edge distanced from the folded edge by the container compartment in the first direction, and wherein the second index is arranged closer than the folded edge to the opening edge in the first direction.

6. The fluid package according to claim 1, wherein the pouch includes, in a range surrounding the container compartment:

a spout-welding section, in which the spout and the film are welded; and a film-welding section, in which a part of the film and another part of the film facing each other with the container compartment interposed there-between in the layered direction are partly welded, and wherein the film includes a transparent window section, in which a part of the directly-bonded area is arranged, at least in one of the spout-welding section and the film-welding section.

7. A fluid package unit, comprising:

a fluid package, comprising:

a pouch having a form of a bag configured to contain fluid in a container compartment delimited by a film, the film including:

an outer layer;

an inner layer arranged closer than the outer layer to the container compartment in a layered direction, in which the outer layer and the inner layer are layered;

a light-shielding layer arranged between the outer layer and the inner layer in the layered direction, the light-shielding layer having an outer periphery located at a position on an inner side with respect to an outer periphery of the outer layer and an outer periphery of the inner layer in an orthogonal direction intersecting orthogonally with the layered direction, the outer periphery of the light-shielding layer being located at one of a same position as an outer periphery of the container compartment and a position on an outer side with respect to the outer periphery of the container compartment in the orthogonal direction, the light-shielding layer covering an entirety of the container compartment, the light-shielding layer being configured to block ultraviolet rays; and a bonding layer bonding the outer layer and the inner layer, with the light-shielding layer interposed between the outer layer and the inner layer, the bonding layer including a directly-bonded area, in which the outer layer and the inner layer are directly bonded with the bonding layer, in a range surrounding the light-shielding layer, and a spout continuous with the container compartment;

an attachment section, to which the fluid package is detachably attachable; and a roll-up assembly configured to roll up the pouch of the fluid package attached to the attachment section, wherein the pouch includes, in a range surrounding the container compartment:

a spout-welding section, in which the spout and the film are welded; and a film-welding section, in which a part of the film and another part of the film facing each other with the container compartment interposed there-between in the layered direction are partly welded, wherein the film-welding section includes a bottom welding section having a triangular form, the bottom welding section being arranged farther than the container compartment from the spout in a first direction parallel to the orthogonal direction, and wherein the pouch is configured to be rolled up by the roll-up assembly in a direction from the bottom welding section toward the spout.

* * * * *